United States Patent [19]

Schaefer

[11] 4,114,295

[45] Sep. 19, 1978

[54] CONVERTIBLE SPORTS SHOE

[76] Inventor: Hans-Joachim Schaefer, Gymnasiumstr. 7, D-6380 Bad Homburg, Fed. Rep. of Germany

[21] Appl. No.: 793,840

[22] Filed: May 5, 1977

[51] Int. Cl.[2] ..... A43B 3/24; A43B 5/04

[52] U.S. Cl. ..... 36/100; 36/115

[58] Field of Search ..... 36/100, 101, 114, 115, 36/117, 132; 280/11.35 A, 11.35 K, 11.35 C, 11.35 D, 11.35 M, 613

[56] References Cited

U.S. PATENT DOCUMENTS 3,898,749 8/1975 Famolare ..... 36/100

3,955,825 5/1976 Kubelka et al. ..... 36/117

FOREIGN PATENT DOCUMENTS 2,328,256 2/1975 Fed. Rep. of Germany ..... 36/115

*Primary Examiner*—Patrick D. Lawson

*Attorney, Agent, or Firm*—Michael J. Striker

[57] ABSTRACT

A convertible sports shoe includes a shoe body having a sole, and a plurality of cooperating projections and recesses provided on a sports device and the sole for detachably connecting the sports device to the shoe body. A plurality of different sports devices are provided, and a selected one of these devices is interchangeably mounted on the sole.

18 Claims, 18 Drawing Figures

FIG. 7
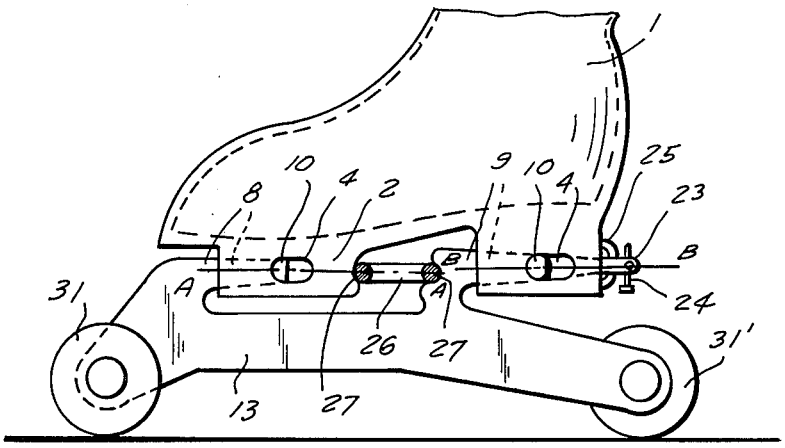
FIG. 8
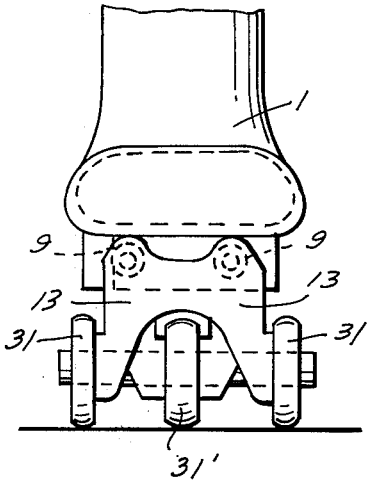
FIG. 12
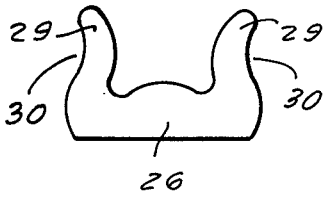
FIG. 14
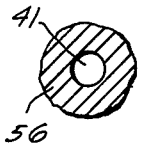
FIG. 15
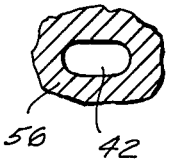
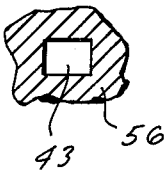
FIG. 16
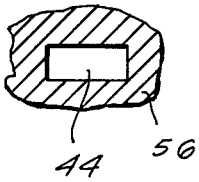
FIG. 17
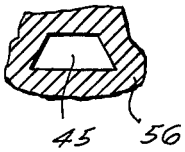
FIG. 18

FIG. 9
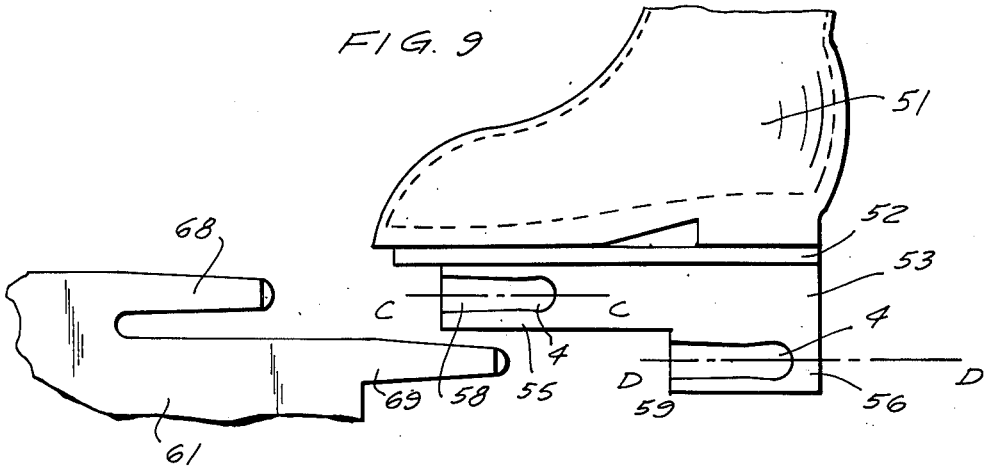
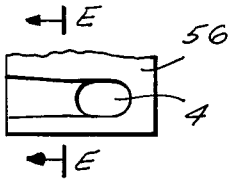
FIG. 13
FIG. 10
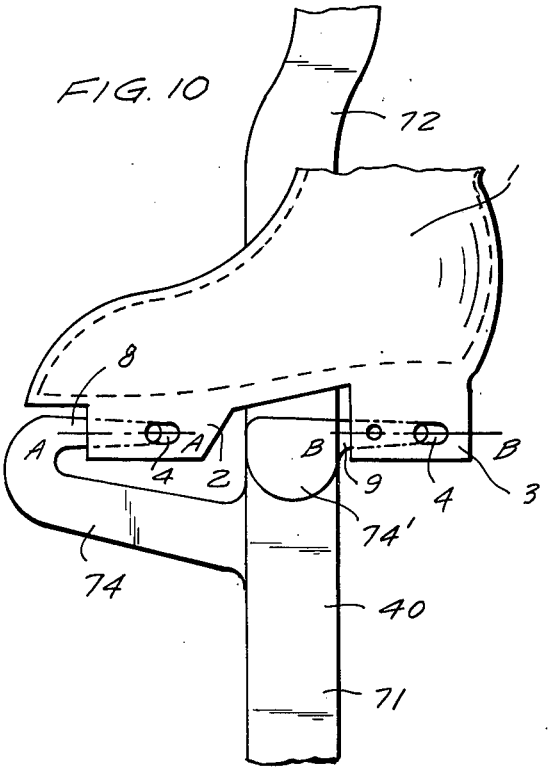
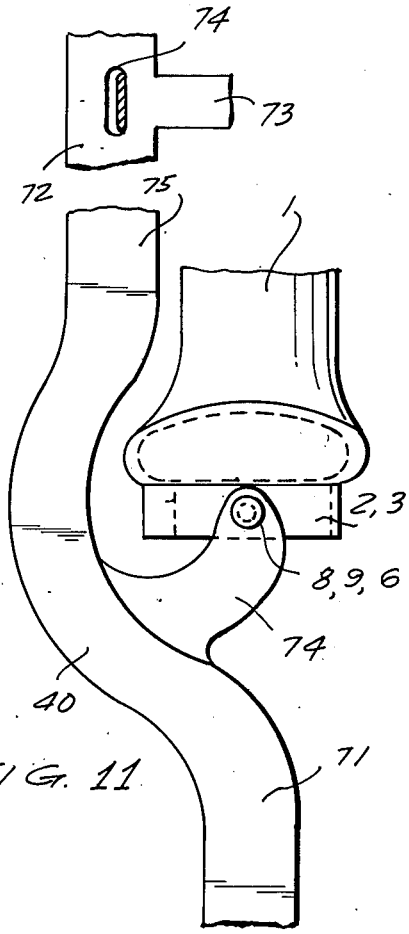
FIG. 11

CONVERTIBLE SPORTS SHOE

BACKGROUND OF THE INVENTION

The present invention relates generally to a convertible sports shoe and an arrangement for converting the shoe for use in different sports.

Sports enthusiasts engage in a great variety of different sporting and athletic events. Such sports include, among others, iceskating, roller skating and walking on stilts.

In order to engage at different times in different sports activities, a number of convertible shoes have been proposed. However, such convertible shoes have not proven altogether satisfactory insofar as ease of convertibility, speed of conversion and accurate positioning of the various interengaging parts of the convertible shoe are concerned.

SUMMARY OF THE INVENTION

Accordingly, it is a general object of the present invention to overcome the drawbacks of the prior art.

Another object of the present invention is to simplify the conversion of a convertible sports shoe to many different sports.

Still another object of the present invention is to increase the speed of conversion from one sports device to another sports device in a convertible sports shoe.

Yet another object of the present invention is to improve the accuracy and fitting interengagement of the sports device on the convertible sports shoe.

In keeping with these objects and others which will become apparent hereinafter, one feature of the invention, briefly stated, is embodied in a shoe body of a shoe having a sole; a sports device; and means for mounting the sports device on the sole. The mounting means includes cooperating projections and recesses provided on both the sports device and the sole for detachably connecting the device to the shoe body.

In accordance with the invention, this so-called "unisports shoe" or convertible shoe may be used for walking and, in addition, may be converted to a sports shoe in dependence upon the particular sports device selected.

In accordance with yet another feature of the invention, a plurality of different sports devices, each adapted for use in a different sport may be provided. A selected one of these devices may be interchangeably mounted on the sole so that a user can engage in whatever sport he wishes. For example, roller skating, iceskating and stilt walking are among the various sports which can be practiced with the convertible sports shoe of the present invention.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 7 is a partial side view of the shoe of FIG. 1 as used as a roller skate;

FIG. 8 is a partial front view of the roller skate of FIG. 7;

FIG. 9 is a partial side view of a third embodiment of the shoe in accordance with the present invention;

FIG. 10 is a partial side view of the shoe of FIG. 1 as used as a stilt;

FIG. 11 is a partial, broken-away front view of the stilt of FIG. 10;

FIG. 12 is a top view of a spring clip as shown in FIG. 7;

FIG. 13 is a partial side view of the heel portion of the shoe of FIG. 9; and FIGS. 14–18 are partial, broken-away section views of various configurations for recesses which are provided on the soles of FIG. 13 taken on line E—E.

DESCRIPTION OF THE PREFERRED EMBODIMENTS

Figure 1:
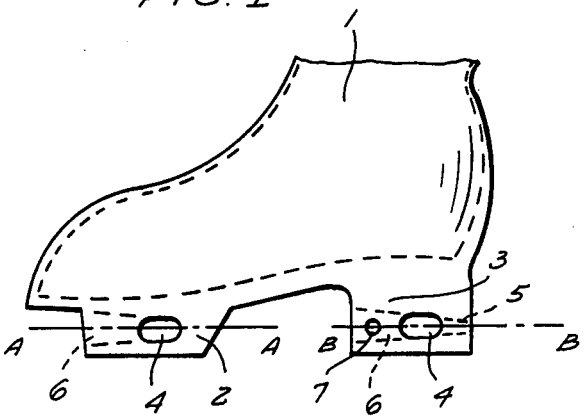
FIG. 1 is a partial side view of a first embodiment of a shoe in accordance with the present invention.

FIG. 1 illustrates a shoe body 1 having a lower sole. The sole has a front or toe portion 2, and a rear or heel portion 3. Each portion 2 or 3 has a recess 6 which is tapered in direction from the front toward the rear of the shoe; that is each recess 6 gradually and continuously converges from left to right in FIG. 1. Two bores 4 respectively extend transversely through toe part 2 and heel part 3. The recess 6 in toe part 2 terminates in bore 4, and the recess 6 in heel part 3 has an extension 5 which continues past bore 4. A passage 7 also extends transversely of heel portion 3 and the passage 7 is operative for fittingly receiving a locking pin for fixing a sports device (e.g., as identified by reference numerals 11, 13, 61 and 71 in FIGS. 5, 7, 9 and 10, respectively) to the sole.

Recess 6 in toe portion 2 is elongated and extends along axis A—A. Recess 6 in heel portion 3 is also elongated and extends along axis B—B. Both of these axes are colinear. Bores 4 are slot-shaped and passage 7 is cylindrically-shaped. Both bores 4 and passage 7 extend normally of axis A—A and axis B—B.

Figure 2:
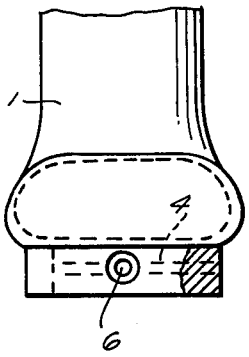
FIG. 2 is a partial front view of the first embodiment of FIG. 1.

FIG. 2 illustrates that the recesses 6 are of circular configuration. However other configurations such as a slot, square, rectangle, or trapezoid (see FIGS. 15–18, respectively) may be used.

Figure 3:
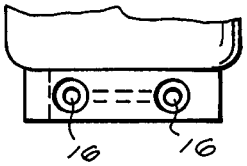
FIG. 3 is a partial front view analogous to FIG. 2 showing a second embodiment of the shoe in accordance with the present invention.

FIG. 3 illustrates that more than one recess can be provided on either the heel or toe portions of the sole. Thus, either the heel or toe portion may have two tapered recesses 16, rather than the single tapered recess 6 as illustrated in FIG. 2.

The shoe body of FIG. 2 or FIG. 3 may be used in connection with a plurality of interchangeable and different sports devices to convert the shoe body to many different types of sports shoes. Sports device 11 in FIGS. 5–6 converts the shoe body 1 into an iceskate. Sports device 13 in FIGS. 7–8 convert the shoe body 1 into a roller skate. Sports device 71 in FIGS. 10–11 convert the shoe body 1 into a stilt. Sports device 61 in FIG. 9 may be used to convert shoe body 51 into any desired sports shoe. Anyone of the aforementioned devices may be selected from all the other of such devices to convert the shoe body to the desired application.

Each sports device has a plurality of projections or inserts which are insertable into a cooperating recess 6 or 16 for retention therein. It will be understood however that each sports device need not be provided with a projection, and each sole need not be provided with cooperating recesses. The reverse situation is equally within the scope of the present invention; that is, the sole may be provided with a projection and the sports devices may each be formed with cooperating recesses. Moreover, either the sole or the sports device may be provided with a combination of such recesses and projections. In any event, whichever sports device or shoe body is used, an equal number of projections and of recesses is needed for mounting a selected one of the sports devices on the shoe body.

Figure 5:
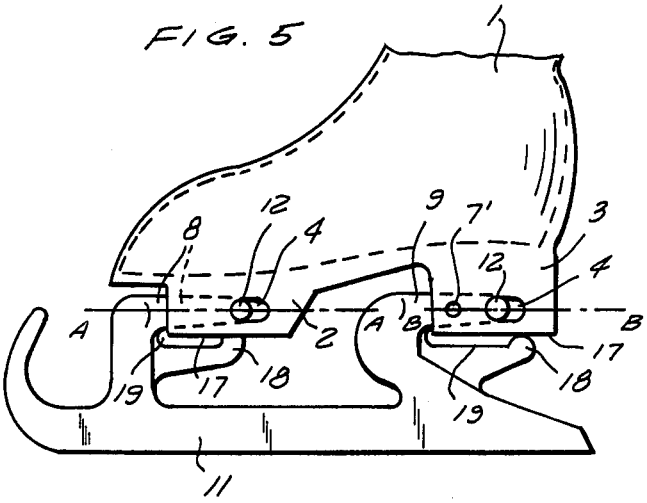
FIG. 5 is a partial side view of the shoe of FIG. 1 as used as an iceskate.

FIG. 5 shows sports device or ice blade 11 mounted on a shoe body 1. Blade 11 has a front projection 8 and a rear projection 9 which are respectively tight-fittingly received in tapered recesses 6 of toe and heel portions 2, 3. Each projection 8 or 9 has a free end 12 which extends past a front leading end of a respective bore 4 and which is spaced at a clearance or predetermined distance from the rear trailing end of the respective bore 4.

In order to fix the position of ice blade 11, a pin 7' or bolt is inserted into cross bore or passage 7. Passage 7 may be located on heel portion 3 as illustrated and/or in toe portion 2. The pin 7' thus firmly secures blade 11 and arrests movement of the latter either towards the front or rear of the iceskate.

Figure 4:
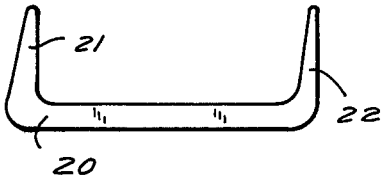
FIG. 4 is a removal tool in accordance with the present invention.

FIG. 4 shows a removal tool having a handle portion 20, and a pair of tapered arms 21, 22 at opposite ends of handle portion 20. In order to demount or remove ice blade 11 from shoe body 1, one first removes pin 7' and thereupon inserts both arms 21, 22 simultaneously into both clearances defined between the free ends 12 and the rear ends of bores 4. The spacing between arms 21 and 22 corresponds to the distance between bores 4. Thereupon, one moves the removal tool towards the front end of bores 4, thereby dislodging the blade from the shoe body. The removal operation is the same for the roller skate of FIGS. 7–8, the sports shoe of FIG. 9 and the stilts of FIGS. 10–11 and will therefore not be repeated in the discussion of those embodiments.

Figure 6:
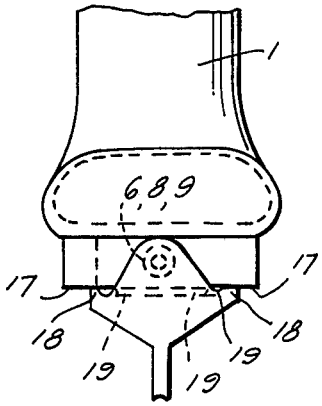
FIG. 6 is a partial front view of the iceskate of FIG. 5.

In case the toe and heel portions are each provided with a single recess 6, and particularly when such recesses 6 have a circular cross-section, the ice blade 11 turns about colinear axes A—A and B—B when forces are exerted against the blade sides. In order to prevent such undesirable turning and therefore to obtain a more stable platform, support portions 18 bear against the undersides 17 of toe and heel portions 2, 3. Support portions 18 may extend continuously across the entire width of the iceskate; alternatively, longitudinal and transverse recesses or channels 19 may respectively extend lengthwise and widthwise of the iceskate, thereby supporting either the toe and/or heel portions at two or more locations at opposite sides of axes A—A and B—B. These intersecting channels 19, as shown in FIG. 6, also facilitate cleaning of the underside of the toe and heel portions where ice tends to accumulate.

Turning can also be prevented by configurating the recesses 6 and cooperating projections 8, 9 as polygons, such as triangular, square, rectangular or any multiangular or irregular configuration. The recesses 6 and projections 8, 9 also need not be tapered and may have parallel side walls.

FIG. 7 shows a roller skate comprised of a roller body 13 having two front wheels 31 and one rear wheel 31' mounted on a shoe body 1. As before, projections 8 and 9 are inserted into recesses 6 of toe and heel portions 2, 3 so that the free end portions 10 are exposed in bores 4. Either insert 8 or 9 may have an extension member 23 which extends through extension passage 5 towards the rear of the roller skate. A locking pin 24 extends through a mounting hole formed in extension member 23. A U-shaped holder member or clamp 25 is mounted on extension member 23 and also engages the shoe body.

The rear side of toe part 2 has a recess or seat 28, and the front side of projection 9 has a recess or seat 27. Intermediate seats 27 and 28, a resilient member or spring clip 26 is snap-mounted. As shown in FIG. 12, clip 26 has a body portion and two resilient arms 29, each arm 29 having an abutment portion 30 which respectively engages seat 27 or 28. The clip 26 is operative for urging the projections 8 and 9 into their respective recesses 6 in direction from the front towards the rear of the roller skate.

FIG. 9 shows a shoe body 51 and a detachable sole 53 having a toe portion 55 and a heel portion 56. Sole 53 is removably connected to shoe body 51 by connecting member 52, or bolts, fasteners, rivets, adhesives and like fasteners. By contrast, shoe body 1 of the other embodiments have integral toe and heel portions which are not removable from the shoe body.

Toe portion 55 has a tapered recess 58 which extends along axis C—C and which terminates in a bore 4. Heel portion 56 has a tapered recess 59 which extends along axis D—D and which terminates in a bore 4. Axis C—C and axis D—D are parallel and offset relative to each other. This embodiment permits not only easy drilling and reaming of the recesses, but also permits easy machining of projections 68 and 69 of generic sports device 61.

FIG. 13 shows the lower portion of heel 56 removed from FIG. 9 for purposes of clarity. FIGS. 14–18 respectively show different cross-sections taken on line E—E of FIG. 13, namely circle 41, slot 42, square 43, rectangle 44 and trapezoid 45. Of course, these various cross-sections are also contemplated for recesses 6 in the other embodiments.

In FIGS. 10 and 11, like reference numerals identify like parts. A stilt pole has a lower upright portion 71 and an upper upright portion 72. Arcuate portions 40 and 75 are located intermediate upright portions 71, 72 so that portion 71 extends along an axis which passes through the line of symmetry of shoe body 1 and so that portion 72 is laterally offset from a side of shoe body 1. Holding member 74 is mounted on arcuate portion 40 and has a projection 8 which is tight-fittingly received in recess 6 of toe portion 2. Supplementary holding member 74' has a projection 9 which tight-fittingly is received in recess 6 of heel portion 3. Handlebar 73 or handholds 74 are provided in upper portion 72 for a user to increase his balance and stability. Alternatively, a band 75 may be inserted in recess 74, the band 75 being operative to strap about a body portion of the stilt user.

It will be understood that each of the elements described above, or two or more together, may also find a useful application in other types of constructions differing from the types described above.

While the invention has been illustrated and described as embodied in a convertible sports shoe, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A shoe sport arrangement, comprising a shoe body having a sole integrally connected to said show body; a plurality of different sports devices, each adapted for use in a different sport, and means for interchangeable mounting a selected one of said devices on said sole, including cooperating projections and recesses provided on each of said devices and said sole, respectively, for detachably connecting a selected one of said sport devices to said shoe body, and elongated bores in communication with said recesses and each extending transversely of said recesses, said projections being partly extendable into said bores so as to permit dislodging of the sports devices by urging the projections lengthwise of the respective recesses by applying pressure on the recesses through the bores and in direction lengthwise of the sole.

2. The arrangement as defined in claim 1, wherein each sports device has at least two of said projections; and wherein said sole has at least two of said recesses for respectively receiving said two projections.

3. The arrangement as defined in claim 2, wherein said sole has a heel portion and a toe portion, each of said portions bounding a respective one of said recesses and having an opening through which a respective one of said projections is inserted.

4. The arrangement as defined in claim 3, wherein each recess is elongated and extends along an axis; and wherein said two recesses have colinear axes.

5. The arrangement as defined in claim 3, wherein each recess is elongated and extends along an axis; and wherein said two recesses have axes parallel and offset relative to each other.

6. The arrangement as defined in claim 1, wherein each recess is tapered along a predetermined direction; and wherein each projection is tapered along said predetermined direction.

7. The arrangement as defined in claim 1, wherein said mounting means further includes means for fixing said selected device to said shoe body.

8. The arrangement as defined in claim 7, wherein said fixing means includes a passage for fittingly receiving a locking pin, said passage extending through said sole and communicating with one of said recesses.

9. The arrangement as defined in claim 7, wherein said selected device has an extension, and wherein said fixing means includes a passage for fittingly receiving a locking pin, said passage extending through said extension.

10. The arrangement as defined in claim 7, wherein said fixing means includes a resilient clip having a main portion and a pair of flexible arms at respective opposite ends of said main portion; and wherein said clip is mounted intermediate a selected one of said sports devices and said sole for urging said selected device into a fixed position relative to said sole.

11. The arrangement as defined in claim 1, wherein said cooperating projections and recesses are elongated along an axis; and wherein said mounting means further includes means for preventing turning movement of said sports device relative to said shoe body about said axis, said preventing means including support portions on a selected one of said devices and engaging said sole.

12. The arrangement as defined in claim 11, wherein said support portions engage said sole at two locations on opposite sides of said axis.

13. The arrangement as defined in claim 1, wherein one of said devices is an ice blade, another of said devices is a roller body, and still another of said devices is a walking stilt pole.

14. An arrangement for converting a shoe for different sports, comprising a shoe having a sole; a plurality of different sports devices each adapted for use in a different sport; and means for interchangeably mounting a selected one of said devices on said sole, including cooperating projections tapered in a predetermined direction and recesses also tapered in said predetermined direction provided on each of said devices and said sole for detachably connecting a selected one of said devices to said shoe body.

15. The arrangement as defined in claim 14, wherein each recess is elongated; and wherein said mounting means further includes bores in communication with said recesses, each of said bores extending transversely of said recesses and having spaced ends; and wherein each projection has a free end which extends past one of said ends of said bore upon insertion of said projection into a respective recess and which is spaced at a clearance from the other of said ends of the respective bore.

16. The arrangement as defined in claim 7; and further comprising means for removing a selected one of said devices from said shoe body including a removal tool having a handle portion and a pair of arms at respective opposite ends of said handle portion, each arm being receivable in a respective clearance.

17. The arrangement as defined in claim 8, wherein each arm extends and is tapered in direction away from said handle portion.

18. A shoe as defined in claim 14, wherein said sole has a heel portion and a toe portion, and wherein one of said portions bounds a pair of recesses, and wherein another of said portions bounds another recess.

* * * * *